US005797407A

United States Patent [19]

Davis et al.

[11] Patent Number: 5,797,407

[45] Date of Patent: Aug. 25, 1998

[54] AUTOMATED NAIL POLISH REMOVER

[75] Inventors: Aaron L. Davis; Mary B. Davis, both of Minnetonka, Minn.

[73] Assignee: Sofspin, San Francisco, Calif.

[21] Appl. No.: 716,026

[22] Filed: Sep. 19, 1996

Related U.S. Application Data

[63] Continuation-in-part of Ser. No. 668,408, Jun. 21, 1996.

[51] Int. Cl.[6] ..... A45D 29/05

[52] U.S. Cl. ..... 132/73.6; 132/73; 132/73.5; 132/75.8; 15/97.1; 15/21.1

[58] Field of Search ..... 132/73, 73.5, 73.6, 132/74.5, 75.8, 76.4, 75; 15/97.1, 21.1; 401/219

[56] References Cited

U.S. PATENT DOCUMENTS

| | | | |
|---|---|---|---|
| 2,703,422 | 3/1955 | Roosa . | |
| 3,181,193 | 5/1965 | Nobles et al. . | |
| 3,392,421 | 7/1968 | Mathison . | |
| 4,117,854 | 10/1978 | Rosenbloom | 132/75.8 |
| 4,282,891 | 8/1981 | Duceppe | 132/73.5 |
| 4,319,596 | 3/1982 | Jackson | 132/73.6 |
| 4,510,954 | 4/1985 | Miller | 132/75 |
| 4,800,606 | 1/1989 | Kolesky | 132/73.6 |
| 5,007,441 | 4/1991 | Goldstein | 132/73.6 |
| 5,054,503 | 10/1991 | Keller | 132/73 |
| 5,065,778 | 11/1991 | Terrell | 132/74.5 |
| 5,139,036 | 8/1992 | Pickard | 132/73.5 |
| 5,339,477 | 8/1994 | Warner et al. | 132/73.6 |
| 5,379,474 | 1/1995 | Nakamura | 15/21.1 |

FOREIGN PATENT DOCUMENTS 1 006 829 4/1957 Germany .

*Primary Examiner*—Gene Mancene
*Assistant Examiner*—Pedro Philogene
*Attorney, Agent, or Firm*—Hunton & Williams

[57] ABSTRACT

A device is disclosed for removing fingernail polish simultaneously from a plurality of fingernails of a hand. The device includes a base having a first area adapted for simultaneously receiving a plurality of fingers of the hand. A rotatable sponge is coupled to the base such that the plurality of fingernails of the hand are positionable in contact with the rotatable sponge when the plurality of fingers are positioned in the first area. A palm positioned in the base and coupled to the rotatable sponge controllably rotates the sponge. A hand activated switch on the base actuates the motor when the plurality of fingers of the hand are positioned in the first area of the base to thereby rotate the sponge and remove the fingernail polish from the plurality of fingernails. A hand activated pump controllably supplies fingernail polish removing fluid to the sponge to aid in removal of the fingernail polish.

24 Claims, 9 Drawing Sheets

AUTOMATED NAIL POLISH REMOVER

BACKGROUND OF THE INVENTION

This is a continuation-in-part application of U.S. patent application Ser. No. 08/668,408 filed Jun. 21, 1996 and entitled AUTOMATED NAIL POLISH REMOVER. Now Pending.

The present invention relates to nail polish removing devices, and more particularly, to a device for use by manicurists or their customers for automatically applying a nail polish removing fluid to the user's fingernails in a controlled manner, while at the same time subjecting the nails to a scrubbing action. The present invention includes features which facilitate clean-up of the nail polish remover and which increase the ease of use of the device as compared to prior art nail polish removers.

One method in widespread use of removing fingernail polish from fingernails involves a person wetting a piece of cotton with fingernail polish removing fluid and then rubbing the fingernails with the wetted cotton until the fingernail polish has been removed. In addition to being overly time consuming, this commonly used method presents the high probability that fingernail polish removing fluid will be inadvertently dripped or spilled onto clothing, carpets or furniture. Further, this method typically requires that fingernail polish be removed from only one fingernail at a time, further lengthening the process.

A number of automatic fingernail polish removing devices are known in the art. These devices typically have a rotating scrubbing member, such as a brush, which sits partially immersed in a reservoir of fingernail polish removing fluid. One or more of the fingernails of the user's hand are placed in contact with the rotating scrubbing member in order to remove the fingernail polish from the fingernails with the help of a fingernail polish removing fluid. One disadvantage of these prior art fingernail polish removing devices is that a large amount of the fingernail polish remover, in which the scrubbing member is partially immersed, is wasted. Another disadvantage is that the rotating scrubbing member is difficult to clean or replace. Yet another disadvantage is that disposal of used fingernail polish removing fluid is frequently a cumbersome and messy task.

Therefore, there is a need for an improved fingernail polish removing device which can be used to remove fingernail polish from the fingernails of a user's hand in a safe, clean and efficient manner without wasting fingernail polish removing fluid.

SUMMARY OF THE INVENTION

A device is disclosed for removing fingernail polish simultaneously from a plurality of fingernails of a hand. The device includes a base having a first area adapted for simultaneously receiving a plurality of fingers of the hand. A rotatable sponge is coupled to the base such that the plurality of fingernails of the hand are positionable in contact with the rotatable sponge when the plurality of fingers are positioned in the first area. A motor positioned in the base and coupled to the rotatable sponge controllably rotates the sponge. A palm activated switch on the base actuates the motor when the plurality of fingers of the hand are positioned in the first area of the base to thereby rotate the sponge and remove the fingernail polish from the plurality of fingernails. A hand activated pump controllably supplies fingernail polish removing fluid to the sponge to aid in removal of the fingernail polish.

In some preferred embodiments of the present invention, the hand activated pump supplies fingernail polish removing fluid to the sponge from a reservoir which can be removed from the base for refilling or to facilitate ease of storage of the device. In some preferred embodiments of the fingernail polish removing device of the present invention, the hand activated pump includes a downwardly extending nozzle which moves toward the rotatable sponge during engagement of the hand activated pump such that fingernail polish removing fluid is delivered in close proximity to the sponge.

In some preferred embodiments, the fingernail polish removing device includes a removable drain pan below the first area for collecting fingernail polish removing fluid runoff from the rotatable sponge. The removable drain pan can be conveniently removed for disposal of the collected fingernail polish removing fluid. In some preferred embodiments, the device of the present invention includes a cleaning member which is movably coupled to the base and selectively moveable into contact with the rotatable sponge while the rotatable sponge rotates, in order to clean the rotatable sponge after use.

DETAILED DESCRIPTION OF THE PREFERRED EMBODIMENTS

Figure 1:
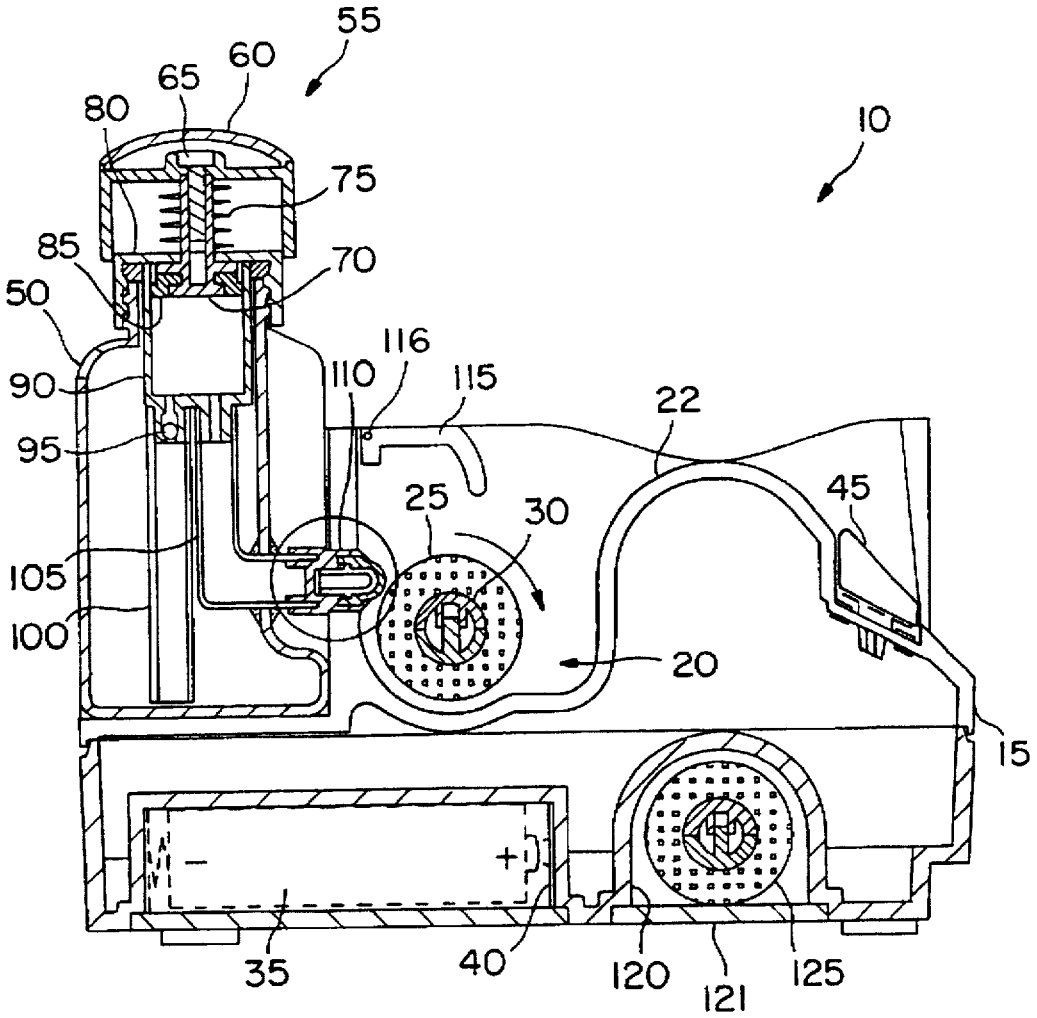
FIG. 1 is a diagrammatic side view, with portions shown in section, of a fingernail polish removing device in accordance with first preferred embodiments of the present invention.

FIG. 1 is a diagrammatic side view, with portions shown in section, of fingernail polish removing device 10 in accordance with some preferred embodiments of the present invention. As illustrated in FIG. 1, device 10 includes base or housing 15 which has finger receiving area 20 formed therein. As is illustrated in greater detail in FIG. 5, base 15 also has raised portion 22 formed therein for supporting the area under the knuckles of a user's hand while the fingers of the hand are inserted into area 20. Device 10 also includes generally cylindrical sponge or scrubbing member 25 which rotates on cartridge housing 30. In other embodiments, scrubbing member 25 can be a brush or other similarly suited rotating scrubbing device.

Battery 35 is positioned in battery compartment 40 formed in base 15. Battery 35 provides one of several possible sources of electrical energy needed to power the motor of device 10. As discussed below with reference to FIG. 4, device 10 can alternatively be controlled to operate from a 120 volt or 240 volt AC power source. To control the supply of energy to the motor of device 10, switch 45 is included on base 15, preferably in a position chosen such that it can be actuated by the palm of the user's hand while the fingers of the hand are inserted into area 20.

Device 10 also includes container or reservoir 50 which holds a supply of fingernail polish removing fluid. Container 50 maintains the supply of fingernail polish removing fluid separate from finger receiving area 20 of base 15 and from sponge or member 25. Pump 55 of device 10 is used to controllably and selectively deliver fingernail polish removing fluid to sponge 25 to aid in the removal of fingernail polish from the fingernails of a user's hand, while reducing or minimizing the waste of fingernail polish removing fluid common in some prior art devices.

Pump 55 includes outside cap 60, screw 65, compression cylinder 70, spring 75, inside cap 80, seal 85, compression tube 90, ball valve 95, first tube 100, second tube 105 and shooter 110. Outside cap 60 is connected to compression cylinder 70 by screw 65. Spring 75 is positioned between outside cap 60 and inside cap 80 so that outside cap 60 and compression cylinder 70 are biased in a non-compressed position. Seal 85 helps to provide an airtight configuration in which compression cylinder 70 can be forced downward into compression tube 90 as manual force is applied to outer cap 60, and in which compression cylinder 70 can be forced upward within compression tube 90 as spring 75 moves outside cap 60 and compression cylinder 70 back toward their resting positions. Compression tube 90 is in fluid communication with container 50 through ball valve 95 and first tube 100. Compression tube 90 is in selective fluid communication with sponge 25 using second tube 105 and shooter or spraying device 110. Thus, the fluid path from container 50, through pump 55, to sponge 25 is controllable in a manually actuated manner to prevent the inefficient use or waste of fingernail polish removing fluid. The configuration of device 10 allows the user to manually control the application of fingernail polish removing fluid with one hand, while removing fingernail polish from the other hand. It should be noted that in other embodiments manual pump 55 can be replaced with an electric or otherwise automated pump to achieve the same objective.

Figure 2:
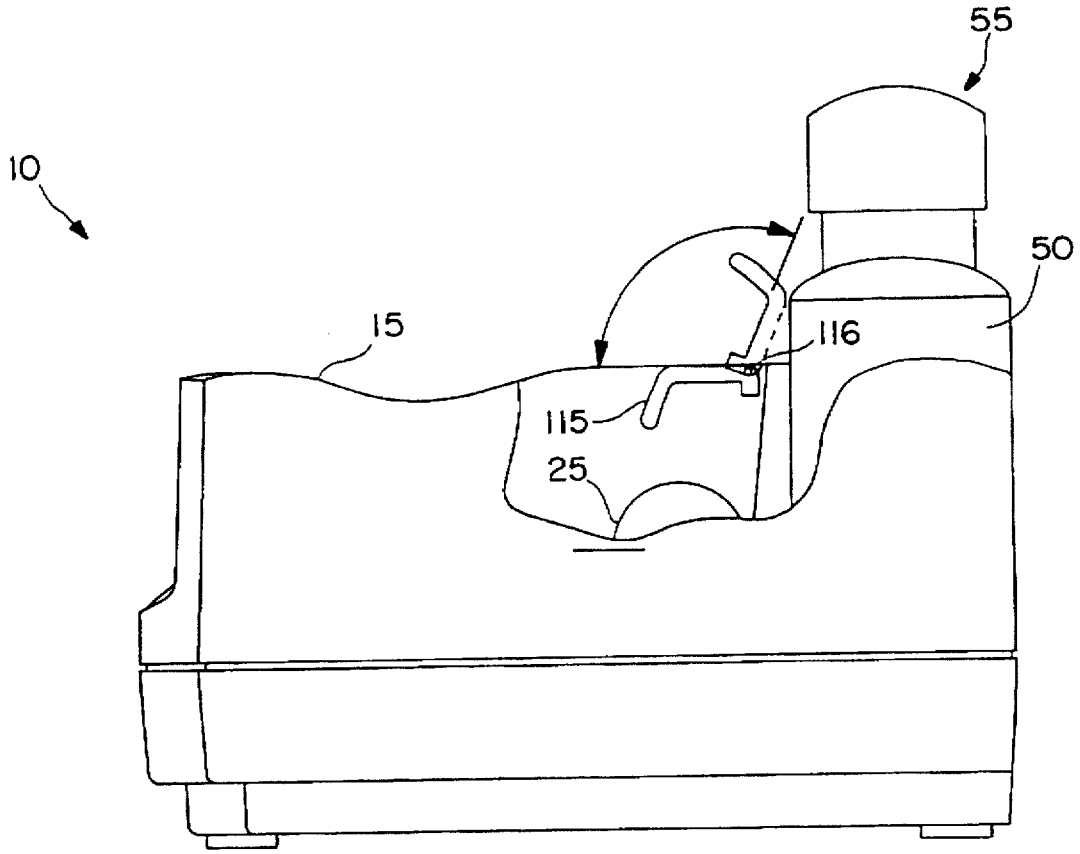
FIG. 2 is a diagrammatic side view of the fingernail polish removing device illustrated in FIG. 1, which further illustrates a movable lid feature of the present invention which allows cleaning or replacement of the rotatable scrubbing member.

Lid 115, which is coupled in a movable fashion to base 15 using pin 116, prevents fingernail polish removing fluid from being sprayed or expelled from finger receiving area 20 by the rotational movement of sponge 25. As illustrated in FIG. 2, lid 115 is rotatably hinged to base 15 by pin 116 such that it can be moved to an open position. As will be discussed later with reference to FIG. 3, with lid 115 in the open position, sponge 25 can be removed from base 15 for cleaning or for replacement. To this end, device 10 includes storage compartment 120 (illustrated in FIG. 1) having lid 121 for storing a replacement sponge 125.

Figure 3:
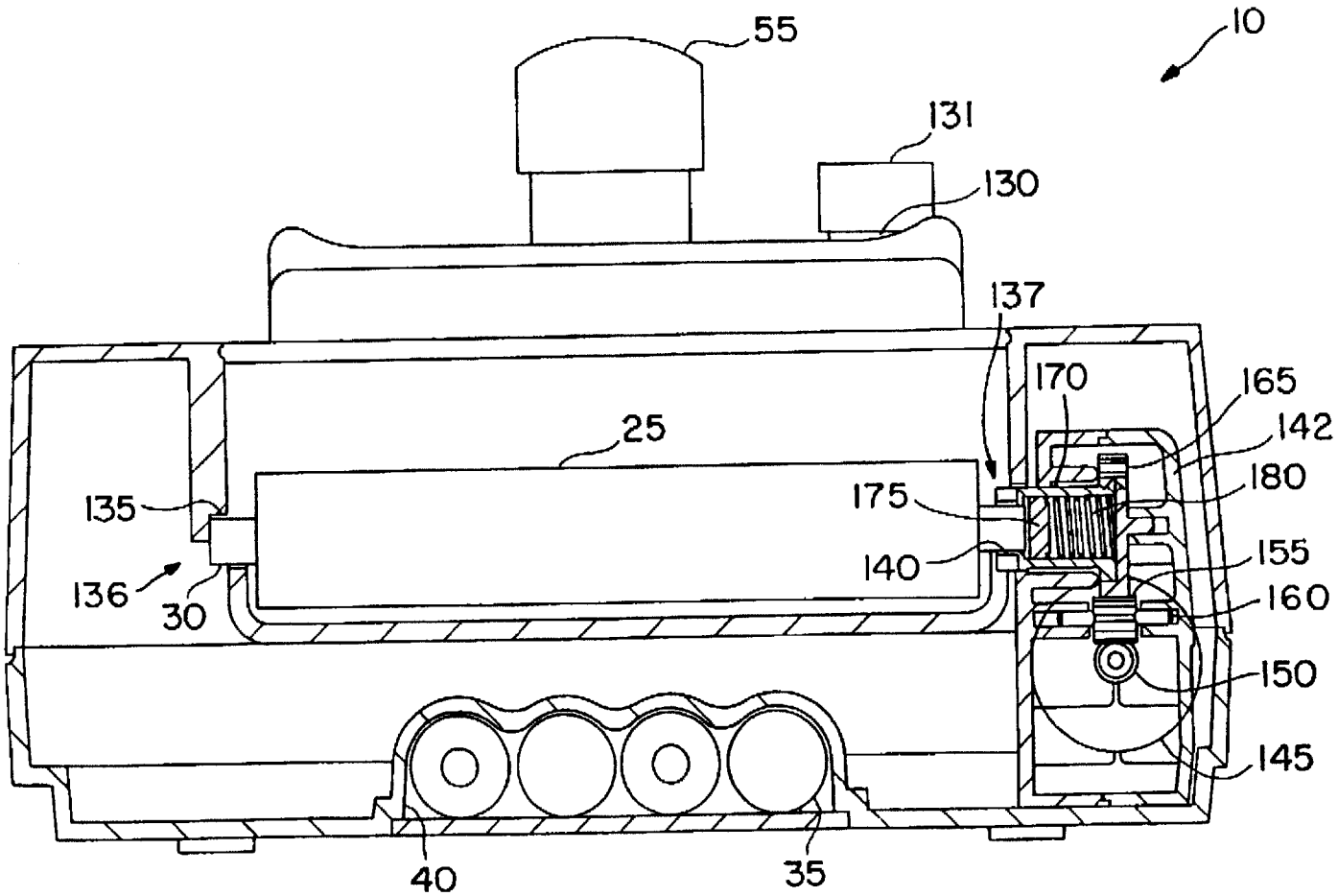
FIG. 3 is a rear view of the fingernail polish removing device illustrated in FIGS. 1 and 2, which further illustrates a gear configuration adapted for allowing the scrubbing member to be removed for cleaning or replacement.

FIG. 3 is a diagrammatic rear view, with portions shown in section, which further illustrates advantageous features of fingernail polish removing device 10 of the present invention. As illustrated in FIG. 3, device 10 includes opening 130 to container 50, and lid 131 for covering opening 130. Thus, container 50 can be easily refilled with fingernail polish removing fluid in a clean, efficient fashion. Also, as illustrated in FIG. 3, device 10 includes cartridge receiving apertures 135 and 140 adapted for receiving first and second ends 136 and 137 of cartridge housing 30.

Device 10 also includes gear box 142, which in turn contains motor 145 and a gear configuration adapted for allowing sponge 25 to be easily removed for cleaning or replacement. Motor 145 is coupled to worm gear 150 for causing rotation of worm gear 150. Worm gear 150 is coupled to pinion gear 155, which rotates on shaft 160 in response to the rotation of worm gear 150. Pinion gear 155 is coupled to output gear 165. Output gear 165 is coupled to output gear adaptor 170 such that output gear 165 and output gear adaptor 170 rotate in unison in response to rotation of pinion gear 155. Compression plate 175 is positioned within output gear adaptor 170. Spring 180 is positioned within output gear adaptor 170, between compression plate 175 and output gear 165. Thus, in normal operation, spring 180 provides a biasing force against compression plate 175 which maintains compression plate 175 in contact with second end 137 of cartridge housing 30. In this manner, when motor 145 is actuated or engaged by compression of switch 45 (illustrated in FIG. 1) during normal operation of device 10, rotational movement of the gears causes rotational movement of compression plate 175, and thus of cartridge housing 30 and sponge 25. However, with lid 115 (illustrated in FIGS. 1 and 2) in an open position, sponge 25 can be removed from finger receiving area 20 by sliding sponge 25 and cartridge housing 30 in a longitudinal direction toward compression plate 175. When spring 180 is sufficiently compressed, first end 136 of cartridge housing 30 clears aperture 135 such that sponge 25 can be removed.

Figure 4:
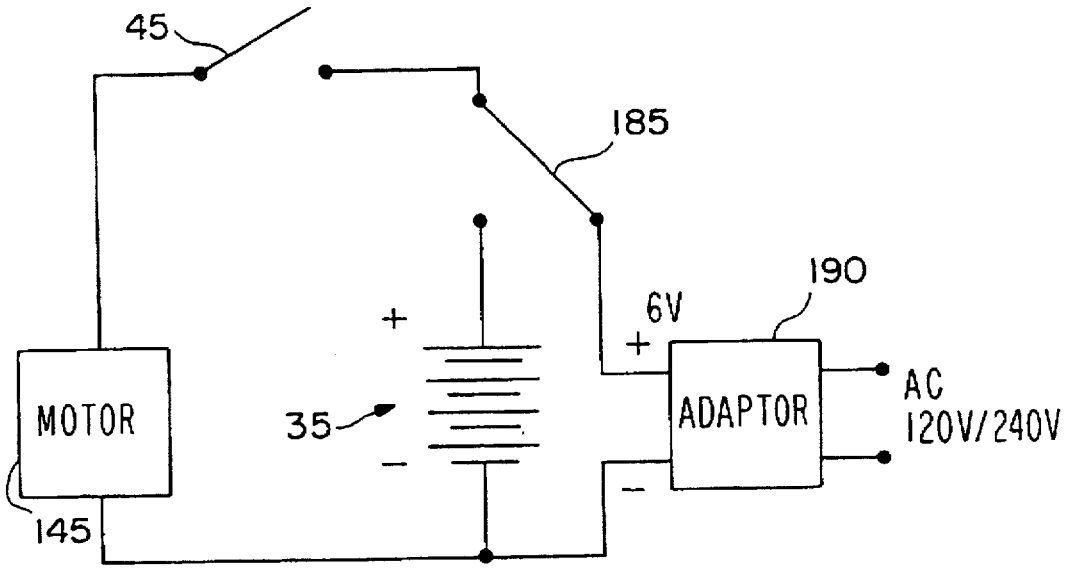
FIG. 4 is a circuit diagram illustrating the various sources of electrical energy which can be used to power the motor of the fingernail polish removing devices of the present invention.

FIG. 4 is a circuit diagram illustrating the various sources of electrical energy which can be used to power fingernail polish removing device 10 of the present invention. As can be seen from the electrical circuit illustrated in FIG. 4, switch 185 can be moved between two positions. In the first position as illustrated, switch 185 couples a DC source of power provided by AC to DC adaptor 190 to the rest of the circuit. In this manner, device 10 of the present invention can be powered using either a 120 volt AC power source or a 240 volt AC power source. Adapters such as adaptor 190 for providing a substantially constant DC power supply (6 volts, as illustrated) from either a 120 volt AC power supply or a 240 volt AC power supply are well-known in the art. In the second position of switch 185, battery 35 provides DC power source for powering device 10. Also as illustrated in FIG. 4, palm actuated switch 45 is biased in a normally open position such that motor 145 receives electrical power only when switch 45 is depressed by the palm of the user's hand.

Figure 5:
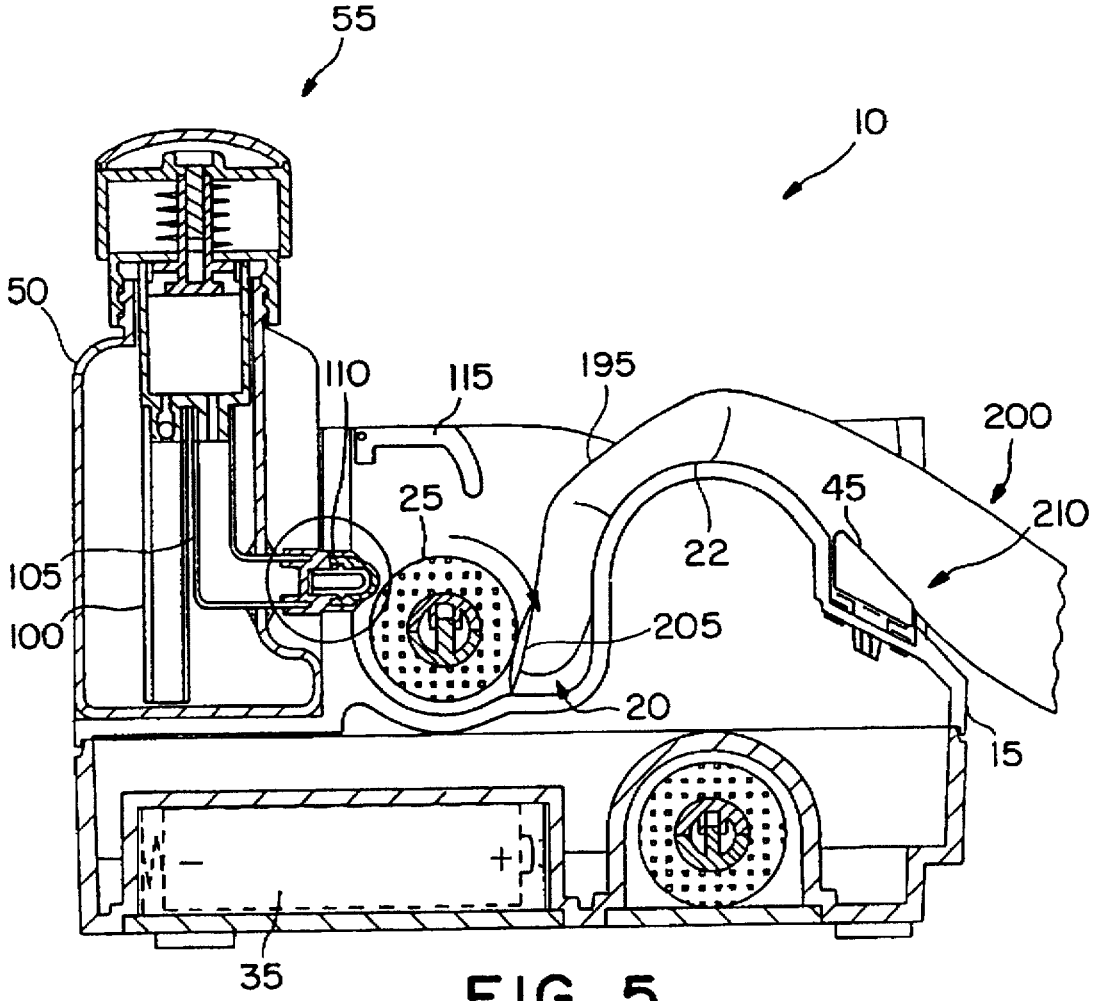
FIG. 5 is a diagrammatic side view with portions shown in section of the fingernail polish removing device illustrated in FIG. 1, which further illustrates the manner in which fingernail polish is removed from the fingernails of a customer's hand.

FIG. 5 is a diagrammatic side view, with portions shown in section, which illustrates operation of device 10 of the present invention in greater detail. As illustrated, fingers 195 of hand 200 of a user have been inserted into finger receiving area 20 of base 15. Raised portion 22 of base 15 supports the user's hand in this position. In this position, fingernails 205 on fingers 195 are positioned adjacent to sponge or scrubbing member 25. Thus, in this position, fingernails 205 are either in contact with sponge 25, or are positioned such that they can be easily placed in contact with sponge 25. Also in this position, palm 210 of hand 200 can be used to depress or actuate switch 45. Thus, motor 145 can be easily controlled to rotate sponge 25 primarily only when hand 200 of the user is in the proper position. This provides increased energy efficiency which will prolong the useful life of batteries 35. Further, with the user able to control motor 145 using only the hand from which the fingernail polish is to be removed, the user's other hand can be employed to manually pump fingernail polish removing fluid from container 50 using pump 55. This provides an additional advantage over conventional fingernail polish removing devices in that the user can control the amount of fingernail polish removing fluid used in order to minimize waste. With a user controlled quantity of fingernail polish removing fluid applied to sponge 25, fingernail polish is efficiently, conveniently and cleanly removed from the fingernails of hand 200.

Figure 6:
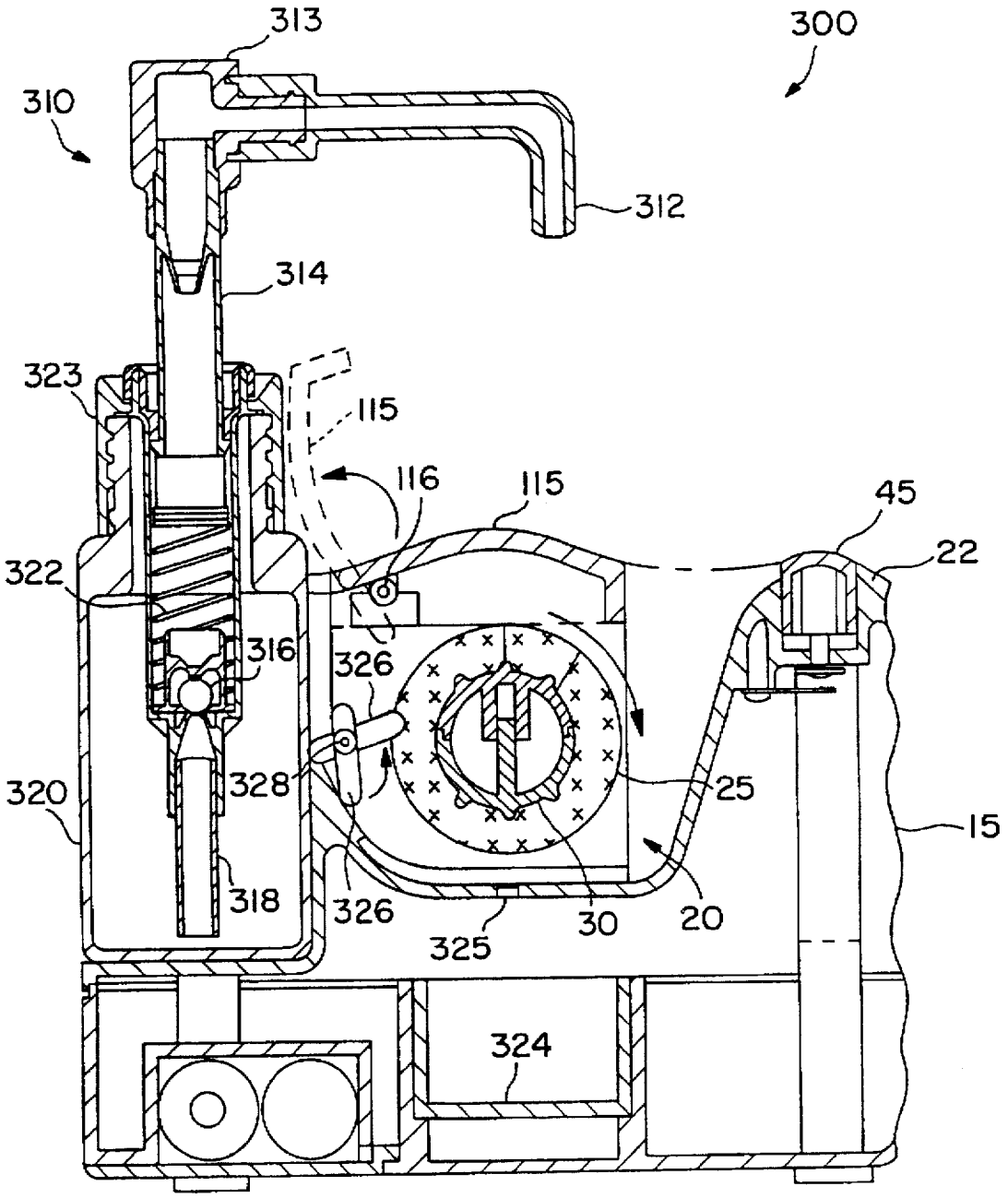
FIG. 6 is a diagrammatic side view, with portions shown in section, of a fingernail polish removing device in accordance with a second preferred embodiment of the present invention.

FIG. 6 is a diagrammatic side view, with portions shown in section, of fingernail polish removing device 300 in accordance with alternate preferred embodiments of the present invention. Except as discussed below, device 300 contains substantially the same components and functions in substantially the same manner as device 10 shown in FIG. 1. Device 300 differs from device 10 in that includes a number of additional or altered features to facilitate ease of use or clean-up of the device.

Like device 10, device 300 includes base or housing 15 having finger receiving area 20 formed therein. Device 300 also includes generally cylindrical sponge or scrubbing member 25 which rotates on cartridge housing 30. Rotation of sponge 25 is facilitated by motor 145 (not shown in FIG. 6) as was the case with device 10. Further, each of devices 10 and 300 include lid 115, which is coupled in a moveable fashion to base 15 using pin 116 to prevent fingernail polish removing fluid from being sprayed or expelled from finger receiving area 20 by rotational movement of sponge 25.

Device 300 differs from device 10 in the following respects. First, the general shape of raised portion 22 formed in base 15 is altered to better support the underside of a user's hand while the fingers of the hand are inserted into area 20 in a manner similar to that shown in FIG. 5. Further, switch 45 is moved from its position in device 10 under the portion of the palm of the user's hand near the user's wrist, to a location at or near the peak of raised portion 22 such that it will be located in closer proximity to the knuckles of the user's hand. Also, as is better seen in FIG. 8, switch 45 is curved along the width of device 300 in order to comfortably and ergonomically fit with the user's hand.

An additional difference between device 300 and device 10 is that pump 55 is replaced with alternate pump design 310. Pump 310 includes downwardly extending nozzle 312 which extends downward toward sponge 25, compressor 313, tube 314, ball valve 316, tube 318, container or reservoir 320, spring loading mechanism 322 and cap 323. Pump 310 functions generally as follows. Upon applying a downward force with a second hand on compressor 313, fluid in tube 314 is forced or expelled out of pump 310 from nozzle 312. Because nozzle 312 moves downward toward sponge 25 when a user's hand forces compressor 313 downward, nozzle 312 places the fingernail polish removing fluid in close proximity to sponge 25, thus minimizing mess and waste of fingernail polish removing fluid. Further, nozzle 312, compressor 313 and tube 314 can be rotated within reservoir 320 about a longitudinal axis (axis 329 shown in FIG. 7) such that nozzle 312 can be selectively directed toward a specific end or middle location of sponge 25. Of course, while pump 310 is used to deliver fingernail polish removing fluid to sponge 25, lid 115 is in the up or open position illustrated in FIG. 6 by dashed lines.

When compressor 313 is allowed to move upward with the help of biasing spring 322, ball valve 316 allows fingernail polish removing fluid from reservoir 320 to be suctioned through tube 318 and into tube 314. Thus, fingernail polish removing fluid is available in tube 314 for the next pumping cycle of pump 310. Pump 310 also includes cap 323 to reservoir 320, which can be removed in order to refill reservoir 320. Further, cap 323 can be removed along with it's cooperating components 312, 313, 314, 316, 318 and 322, and replaced with a solid cap. Thus, after these components of pump 310 have be removed from reservoir 320, the reservoir can be tightly sealed for storage or travel.

A further advantageous feature of device 300 is that reservoir or container 320 is coupled to base 15 during use, but can be slideably or otherwise removed from base 15 for refilling, storage or travel. This feature is best illustrated in FIG. 7 which shows reservoir 320 fitting within, but having slightly different shape and dimensions than, the cooperating portion of base 15.

Another advantageous feature of device 300 relates to cleaning device or member 326. Member 326 is rotatably coupled to base 15 by pin or rod 328. While device 300 is used to remove fingernail polish from the fingers of the user's hand, cleaning member 326 is maintained in a position away from sponge 25. When device 300 is not in use for removing fingernail polish from a user's hand, and when sponge 25 is in need of cleaning, cleaning member 326 is rotated about pin 328 into contact with sponge 25 as sponge 25 rotates. Thus, cleaning member 326 provides a squeezing, scrapping or squeegeeing function for cleaning sponge 25. Knob 330 (shown in FIG. 7) is used to rotate cleaning member 326.

Another advantageous feature of device 300 is that it includes removable drain pan or reservoir 324 for collecting fingernail polish fluid runoff from sponge 25. Fingernail polish removing fluid runoff from sponge 25 flows through drain holes or apertures 325 into drain pan 324 during use. After using device 300 to remove fingernail polish from the fingernails of a user's hand, drain pan 324 can be slideably removed in order to dispose of the used fingernail polish removing fluid. This feature is further illustrated in FIG. 11. An additional feature shown in FIG. 6 relates to the cartridge housing 30, on which the scrubbing member 25 is seated. As shown, the cartridge housing 30 comprises a plurality of projections. For example, the cartridge housing 30 may comprise a generally cylindrical housing having a plurality of projections extending outwardly therefrom, along a portion of, and spaced about the circumference of the cylindrical housing.

Figure 7:
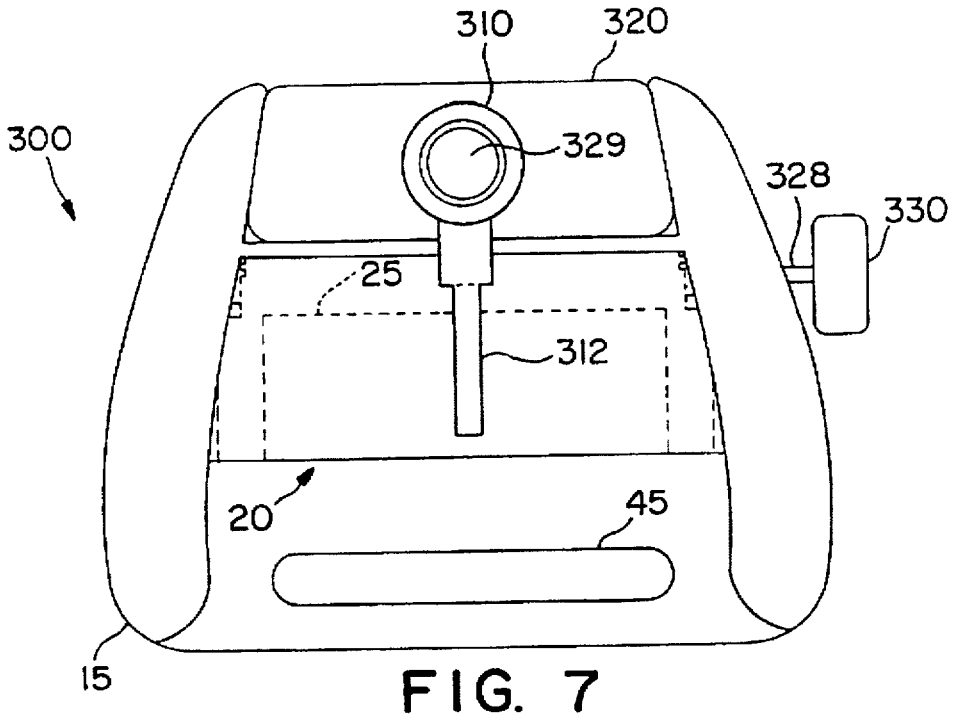
FIG. 7 is a top view of the fingernail polish removing device illustrated in FIG. 6, which further illustrates advantageous features of the present invention.

FIG. 7 is a top view of device 300 which further illustrates the advantageous features of the present invention. As can be clearly seen in FIG. 7, switch 45 is located in close proximity to finger receiving area 20. Further, nozzle 312 is positioned directly over area 20 and sponge 25. Also, nozzle 312 of pump 310 can be pivoted about axis 329 to tailor the delivery of fingernail polish removing fluid to specific locations of sponge 25.

As can be seen in FIG. 7, container or reservoir 320 has dimensions and a shape which are adapted to enable reservoir 320 to be lifted upward and away from base 15 for refilling, storage or travel. Also illustrated in FIG. 7 is knob 330 coupled to pin or rod 328, and thereby to cleaning member 326 (shown in FIG. 6). In order to engage or disengage cleaning member 326 from sponge 25, knob 330 is rotated in the corresponding clockwise or counterclockwise direction.

Figure 8:
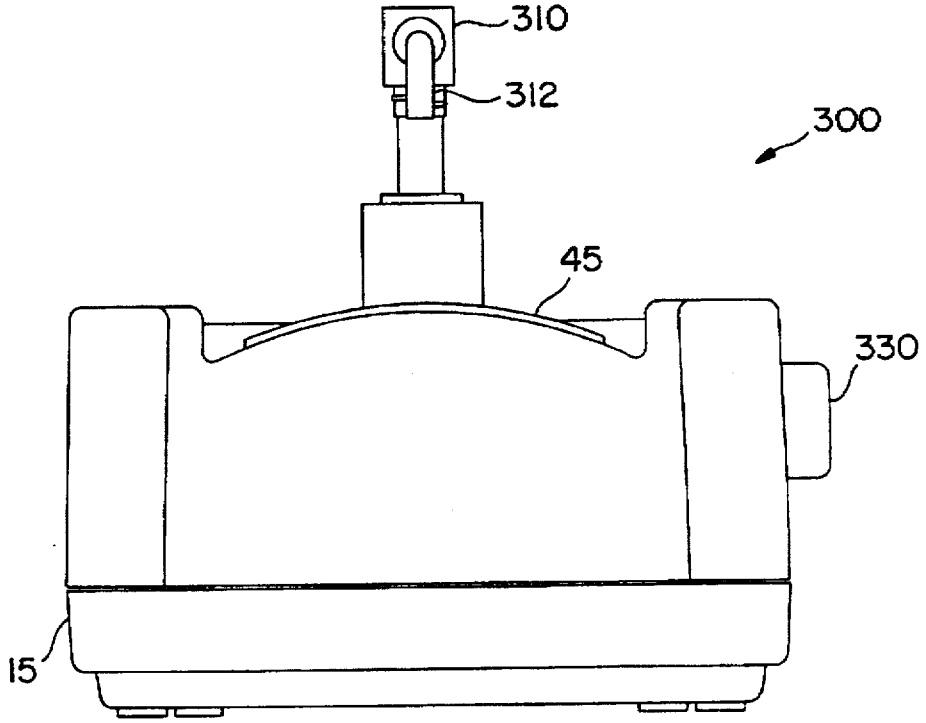
FIG. 8 is a front view of the fingernail polish removing device illustrated in FIG. 6, which further illustrates advantageous features of the present invention.

FIG. 8 is a front view which further illustrates the advantageous features of device 300 of the present invention. As shown in FIG. 8, switch 45 has a curved shape adapted for comfortable cooperation with the underside of a user's hand. Also shown in FIG. 8 are knob 330 for engaging and disengaging cleaning member 326, and downwardly extending nozzle 312 of pump 310 for delivering fingernail polish removing fluid to sponge 25 in a clean and controlled manner.

Figure 9:
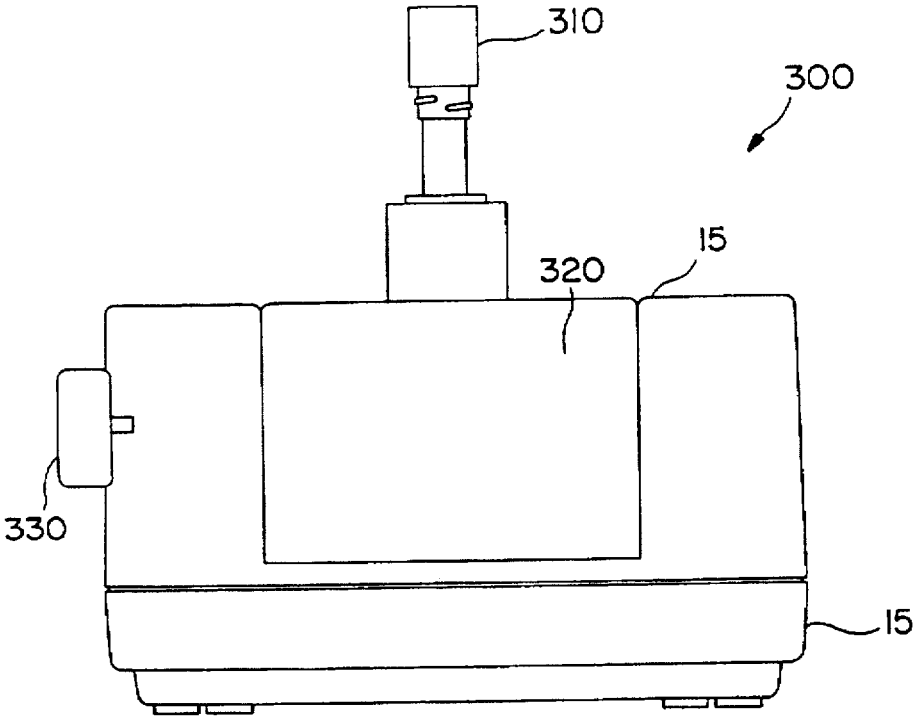
FIG. 9 is rear view of the fingernail polish removing device illustrated in FIG. 6, which further illustrates advantageous features of the present invention.
Figure 10:
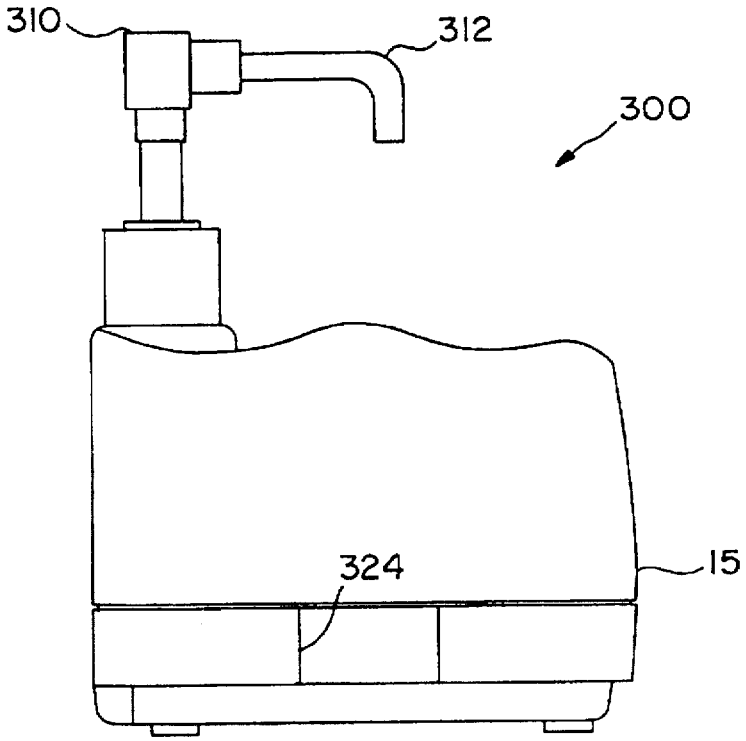
FIG. 10 is a side view of the fingernail polish removing device illustrated in FIG. 6, which further illustrates advantageous features of the present invention.
Figure 11:
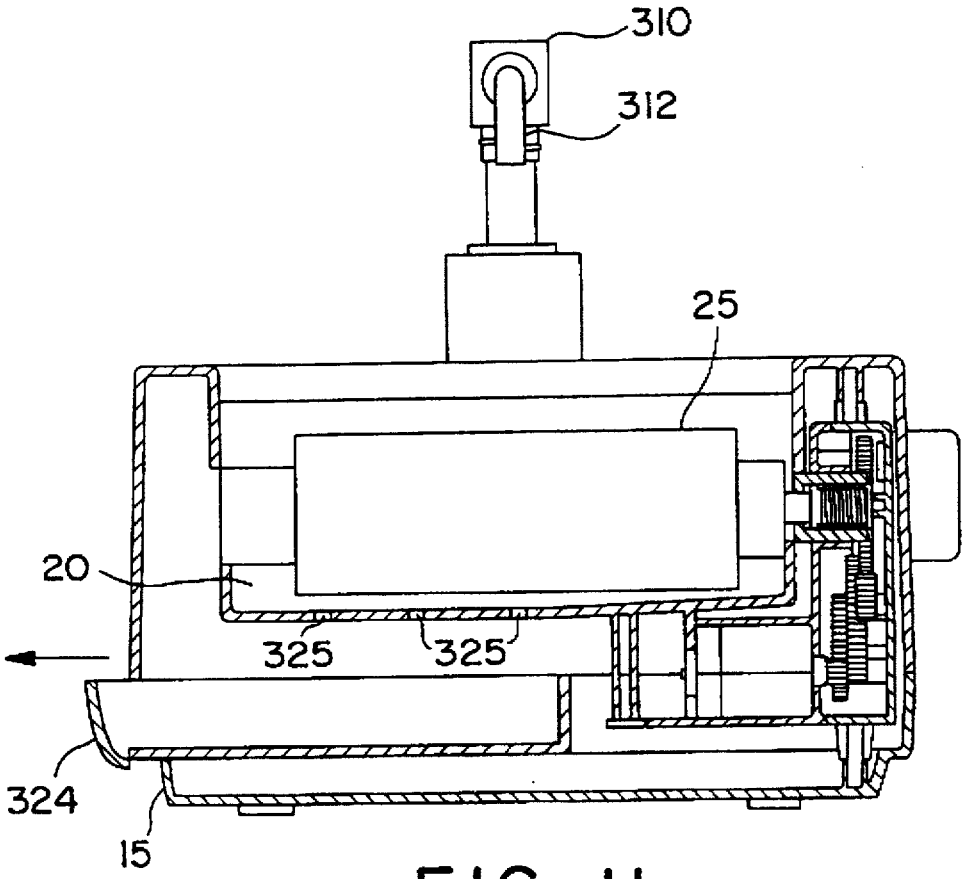
FIG. 11 is a diagrammatic front view, with portions shown in section, of the fingernail polish removing device shown in FIG. 6, and which further illustrates advantageous features of the present invention.

FIG. 9 is a rear view of device 300 which illustrates the shape of reservoir 320 and base 15 which allows reservoir 320 to be lifted upward out of contact with base 15 when desired. FIG. 10 is a side view which illustrates removable drain pan 324 of base 15 for collecting fingernail polish removing fluid runoff from nozzle 312 and from sponge 25. Operation of drain pan 324 is better shown in FIG. 11. As shown in FIG. 11, base 15 includes drain holes 325 positioned under finger receiving area 20 and sponge 25 for draining fingernail polish removing fluid runoff into drain pan 324. Drain pan 324 can be slid in the direction of the arrow in order to remove drain pan 324 from the remainder of base 15. In this manner, fingernail polish removing fluid runoff can be disposed of in a clean and convenient manner.

Although the present invention has been described with reference to preferred embodiments, workers skilled in the art will recognize that changes may be made in form and detail without departing from the spirit and scope of the invention.

What is claimed is:

1. A device capable of removing fingernail polish simultaneously from a plurality of fingernails of a first hand, said device a base having a first area capable of simultaneously receiving a plurality of fingers of the first hand a scrubbing member;

a container coupled to the base for holding fingernail polish removing fluid, the container holding the fingernail polish removing fluid separate from the first area of the base;

a downwardly extending nozzle coupled to the reservoir and adapted for selectively delivering fingernail polish removing fluid to the scrubbing member; and a pump connected to the reservoir for selectively pumping fingernail polish removing fluid from the reservoir and through the downwardly extending nozzle to the scrubbing member.

2. The device of claim 1 wherein the pump is a hand actuated manual pump capable of being actuated by a second hand while the plurality of fingers of the first hand are positioned in the first area of the base, wherein actuation of the pump by the second hand causes the downwardly extending nozzle to move downward toward the scrubbing member such that the fingernail polish removing fluid is delivered to the scrubbing member.

3. The device of claim 1 wherein the container is selectively removable from the base.

4. A device capable of removing fingernail polish simultaneously from a plurality of fingernails of a first hand, said device comprising:

a base having a first area capable of simultaneously receiving a plurality of fingers of the first hand:

a scrubbing member; and a removable drain pan coupled to the base below the first area for collecting used fingernail polish removing fluid, wherein the drain pan is removable for disposing of the used fingernail polish removing fluid.

5. The device of claim 4, and further comprising a cleaning member movably coupled to the base, the cleaning member being selectively movable into contact with the rotatable scrubbing member while the rotatable scrubbing member rotates in order to clean the rotatable scrubbing member.

6. The device of claim 4, wherein the switch has a curved portion for engagement by the palm of the first hand such that the switch can be actuated by the palm of the first hand when the plurality of fingers of the first hand are positioned in the first area of the base.

7. A device capable of removing fingernail polish simultaneously from a plurality of fingernails of a first hand, said device comprising;

a base having a first area capable of simultaneously receiving a plurality of fingers of the first hand;

a scrubbing member;

a reservoir coupled to the housing for holding fingernail polish removing fluid, wherein the reservoir is removable from the housing; and a pump connected to the reservoir for controllably pumping fingernail polish removing fluid from the reservoir to the rotatable member.

8. The device of claim 7 wherein the pump is a hand actuated manual pump adapted for actuation by a second hand while the plurality of fingers of the first hand are positioned in the first area of the housing, wherein the pump includes a downwardly extending nozzle for delivering fingernail polish removing fluid from the reservoir to the rotatable member, and wherein actuation of the pump by the second hand causes the downwardly extending nozzle to move downward toward the rotatable member such that fingernail polish removing fluid is delivered in close proximity to the rotatable member.

9. The device of claim 7 and further comprising a lid movably coupled to the housing such that the lid, in a first lid position, helps prevent fingernail polish removing fluid from being expelled from the housing during operation of the scrubbing member, and, in a second lid position, enables removal of the scrubbing member from the housing.

10. The device of claim 7 and further comprising a rotatable member storage area in the housing for storing a replacement rotatable member.

11. The device of claim 7, wherein the housing further comprises a removable container positioned below the first area for collecting fingernail polish removing fluid runoff from the rotatable member, wherein the container is removable for disposing of the collected fingernail polish removing fluid.

12. A device capable of removing fingernail polish simultaneously from a plurality of fingernails of a first hand, said device comprising;

a base having a first area capable of simultaneously receiving a plurality of fingers of the first hand;

a rotatable member; and a cleaning device movably coupled to the housing, the cleaning device being selectively movable into contact with the rotatable member while the rotatable member is rotated in order to clean the rotatable member.

13. The device of claim 12, wherein the cleaning device includes a bar rotatably attached to the housing, wherein the bar is coupled to a knob on the housing and is moved into contact with the rotatable member by rotating the knob on the housing.

14. A device for removing fingernail polish simultaneously from a plurality of fingernails of a first hand using fingernail polish removing fluid comprising:

a base having a finger receiving area adapted for simultaneously receiving a plurality of fingers of the first hand;

a scrubbing member coupled to the base such that the plurality of fingernails of the first hand are positioned adjacent to the scrubbing member when the plurality of fingers of the first hand are positioned in the finger receiving area of the base;

a motor operatively connected to the scrubbing member for causing relative movement between the scrubbing member and the fingernails when the motor is actuated;

a switch electrically coupled to the motor such that actuation of the switch causes the motor to be actuated and thereby enable removal of the fingernail polish from the plurality of fingernails;

a reservoir coupled to the base for holding fingernail polish removing fluid, the reservoir holding the fingernail polish removing fluid separate from the finger receiving area of the base, the reservoir being selectively removable from the base; and a fluid pump connected to the reservoir for selectively pumping fingernail polish removing fluid from the reservoir to the rotatable member.

15. The device of claim 14 wherein the pump is a hand actuated manual pump adapted for actuation by a second hand while the plurality of fingers of the first hand are positioned in the finger receiving area of the base, the pump including a downwardly extending nozzle for delivering pumped fingernail polish removing fluid to the rotatable member, wherein hand actuation of the pump by the second hand causes the downwardly extending nozzle to move toward the rotatable member such that pumped fingernail polish removing fluid is delivered in close proximity to a location of the rotatable member.

16. A device capable of removing fingernail polish simultaneously from a plurality of fingernails of a first hand, said device comprising:

a base having a first area capable of simultaneously receiving a plurality of fingers of the first hand;

a rotatable member;

a reservoir coupled to the base for holding fingernail polish removing fluid, the reservoir holding the fingernail polish removing fluid separate from the finger receiving area of the base, the reservoir being selectively removable from the base; and a cleaning device movably coupled to the base, the cleaning device being selectively movable into contact with the rotatable member while the rotatable member is rotated in order to clean the rotatable member.

17. An automated fingernail polish remover comprising:

a housing;

a first area of said housing adapted to receive a plurality of fingers of a first hand;

first means operatively positioned with respect said first area and being capable of simultaneously removing fingernail polish from said plurality of fingers; and second means formed in the housing for receiving a separate container of fingernail polish removing fluid and for permitting the container to be removed from the housing.

18. The automated fingernail polish remover of claim 17, wherein said second means is contoured to slidably receive said container.

19. The automated fingernail polish remover of claim 17, wherein said second means is positioned to locate said container in a position to enable contents of said container to be dispensed toward the first means.

20. The automated fingernail polish remover of claim 17, further comprising a container for holding fingernail polish removing material, said container comprising means for dispensing said material towards said first means.

21. The automated fingernail polish remover of claim 20, wherein said means for dispensing comprises a first delivery portion and a second delivery portion forming approximately a 90° with respect to the first delivery portion.

22. The automated fingernail polish remover of claim 17, said first means comprising a scrubbing member, further comprising a container for holding fingernail polish removing material, said container comprising means for directing said material to a desired portion of said scrubbing member.

23. The automated fingernail polish remover of claim 22, wherein said means for dispensing comprises a first delivery portion and a second delivery portion forming approximately a 90° with respect to the first delivery portion.

24. An automated fingernail polish remover comprising:

a housing;

a first area of said housing adapted to receive a plurality of fingers of a first hand;

first means operatively positioned with respect said first area and being capable of simultaneously removing fingernail polish from said plurality of fingers, said first means comprising a cartridge housing comprising a plurality of projections and a scrubbing member located on said cartridge housing.

* * * * *